US009095766B1

(12) United States Patent
Christie

(10) Patent No.: US 9,095,766 B1
(45) Date of Patent: Aug. 4, 2015

(54) FOLDING CONCEALABLE SKATEBOARD

(71) Applicant: Andrew Leigh Christie, Brooklyn, NY (US)

(72) Inventor: Andrew Leigh Christie, Brooklyn, NY (US)

( * ) Notice: Subject to any disclaimer, the term of this patent is extended or adjusted under 35 U.S.C. 154(b) by 0 days.

(21) Appl. No.: 14/556,619

(22) Filed: Dec. 1, 2014

Related U.S. Application Data

(60) Provisional application No. 61/947,288, filed on Mar. 3, 2014.

(51) Int. Cl.
*B60M 1/00* (2006.01)
*A63C 17/01* (2006.01)

(52) U.S. Cl.
CPC ..... *A63C 17/01* (2013.01)

(58) Field of Classification Search
CPC ..... B60K 3/002
USPC ..... 280/87.05, 87.042
See application file for complete search history.

(56) References Cited

U.S. PATENT DOCUMENTS

| | | | | |
|---|---|---|---|---|
| 3,285,618 | A * | 11/1966 | Welch | 280/11.115 |
| 4,962,968 | A | 10/1990 | Caplin | 301/108 SC |
| 6,131,931 | A | 10/2000 | Globerson et al. | 280/87.042 |
| 6,443,471 | B1 | 9/2002 | Mullen | 280/87.042 |
| 8,201,837 | B2 | 6/2012 | Dweek | 280/30 |
| 8,317,206 | B1 | 11/2012 | Novitzky et al. | 280/87.042 |
| 8,459,670 | B1 * | 6/2013 | Tizzone | 280/87.042 |
| 8,746,715 | B2 | 6/2014 | Woncik | 280/87.042 |
| 8,752,746 | B2 | 6/2014 | Dee | 224/578 |
| 2005/0212246 | A1 | 9/2005 | Hong | 280/87.042 |

* cited by examiner

*Primary Examiner* — John Walters
*Assistant Examiner* — James Triggs
(74) *Attorney, Agent, or Firm* — Sunstein Kann Murphy & Timbers LLP

(57) ABSTRACT

A skateboard can transform into a handheld case that obstructs the view of the wheel and truck assemblies. Once transformed, the wheel assemblies are located in an interior of the case. The skateboard has a multi-part platform, more than one wheel assembly and a handle for use in the transformed configuration.

9 Claims, 15 Drawing Sheets

FOLDING CONCEALABLE SKATEBOARD

CROSS REFERENCE TO RELATED APPLICATIONS

This application claims the benefit of U.S. Provisional Patent Application No. 61/947,288, filed Mar. 3, 2014 by Andrew Leigh Christie, titled "Skateboard that can transform into a hand-held case with handle," the entire contents of which are hereby incorporated by reference herein, for all purposes.

TECHNICAL FIELD

The present invention relates to folding skateboards and, more particularly, to such skateboards that conceal their functions while stored.

BACKGROUND ART

Skateboarding is a popular recreational activity and a practical means of commuting enjoyed by many youth and adults alike. Increasingly, as people who skateboarded for pleasure in their youth age and obtain long-term employment, there has been a trend towards skateboarding to work by means of skateboards. Due to the culture surrounding skateboarding and public perception of the activity as a sport for rebellious youth, skateboarders who now desire to skateboard to their place of employment may suffer derision from colleagues who may frown upon the activity. Furthermore once a skateboarder has arrived at his or her destination, he or she may find it cumbersome to carry the skateboard in its current popular embodiment.

The prior art teaches foldable skateboards and/or skateboard components. For example, U.S. Pat. No. 4,962,968 to Caplin and U.S. Pat. No. 6,443,471 to Mullen describe various skateboard components.

U.S. Pat. No. 8,746,715 to Woncik, U.S. Pat. Publ. No. 2005/0212246 to Hong and U.S. Pat. No. 6,131,931 to Globerson describe methods for reducing the dimensions of a skateboard by means of folding the skateboard deck in various manners. Where these embodiments fail is in concealing the functionality of the skateboard, as well as omission of a manner of conveniently carrying the skateboard in the folded configuration.

U.S. Pat. No. 8,201,837 to Dweek shows a device which combines a skateboard-like platform joined to a suitcase piece with a handle, allowing a person to stow the skateboard portion within the bag after travel. This device changes the riding style of the skateboard to something that more resembles a scooter. In addition, the combination described by Dweek is bulky and is thus non-conducive to a business setting.

U.S. Pat. No. 8,317,206 to Novitzky shows a skateboard with an internal compartment located inside the deck, inside which can be stored various objects such as writing implements and stationery. The top surface is shown to be removable, hinged to the main body of the device, and closed using latches located along the edge of the deck. One embodiment shown describes the wheel trucks of the skateboard folding into the body of the skateboard, effectively hiding them. Also included is a handle incorporated into the side of the deck that can be extended to carry the skateboard. While the ability to store personal effects inside a skateboard is valuable, what this invention lacks is a method to reduce the length of the skateboard so as to be easily storable. In addition, the chosen method of concealing the wheels carries the risk that the wheel trucks will collapse while the skateboard is in use.

U.S. Pat. No. 8,752,746 to Dee is a system for carrying a skateboard integrated into a belt that allows a skateboard to be carried on rider's back. Loops along the length of the belt are hooked around the wheel platforms of the skateboard, which lets the person sling the board around his or her shoulders. This design presents various problems, first of which is the need to remove the belt from the person's waist before being able to carry the board. This is a step that requires time and robs the rider of the use of their belt. Secondly, the surface of the board comes into contact with the back of the person carrying the skateboard, which carries the danger of soiling the person's clothes. Third, the back strap in no way conceals the skateboard. For these reasons this object does not satisfy the requirements of skateboarding commuters.

SUMMARY OF EMBODIMENTS

An embodiment of the present invention provides a folding skateboard. The skateboard has concealable wheels. The skateboard may be folded to conceal the wheels. Thus, when folded, the skateboard does not appear to be a skateboard. Furthermore, its length is reduced, thereby facilitating carrying and storing the folded skateboard. However, in its unfolded configuration, the skateboard may be operated as a conventional skateboard.

The skateboard is for use by a human. The skateboard includes a first platform, a second platform and a first hinge. The first platform includes a first wheel. The first platform may include one or more additional wheels. The first platform defines a first surface adapted to receive at least a portion of a foot of the human. The second platform is disposed along a longitudinal axis shared with the first platform. The second platform includes at least one second wheel. The second platform may include one or more additional wheels. The second platform defines a second surface adapted to receive at least a portion of another foot of the human. The first hinge has a pivot axis substantially perpendicular to the longitudinal axis. The first platform is hingedly coupled to the second platform by the hinge.

A first skirt is attached to the first platform. At least in a first mode, the first skirt extends from the first platform in a direction, relative to the platform, opposite to the first surface. At least in the first mode, the first skirt extends a distance at least equal to a radius of the at least one first wheel. Thus, when the skateboard is folded, the first skirt hides at least a portion of at least one of the first and second wheels.

Optionally, the skateboard also includes a second skirt attached to the second platform. At least in the first mode, the second skirt extends from the first platform in a direction, relative to the platform, opposite to the second surface. At least in the first mode, the second skirt extends a distance at least equal to a radius of the at least one second wheel. Thus, when the skateboard is folded, the second skirt hides at least a portion of at least one of the first and second wheels.

Optionally, the first platform also includes a second hinge. The first platform may include a first portion and a second portion. The second portion of the first platform may be hingedly coupled to the first portion of the first platform by the second hinge. The first surface may extend over the first portion and over the second portion. The first skirt may be attached to the first portion of the first platform.

The first skirt may be retractable. As used herein, "retractable" means hinged, rollable, bendable, accordion folded or flexible, as the case may be. Thus, the first skirt may be hingedly attached to the first platform such that, for example in a second mode, the first skirt may be swung under or over the first platform. Alternatively, the first skirt may be bendably attached to the first platform such that, for example in a second mode, the first skirt may be swung under or over the first platform. Alternatively, the first skirt may be flexible such that, for example, the first skirt may be rolled up, and the rolled-up first skirt may then reside under or over the first platform.

The first skirt may define a plurality of apertures therethrough. For example, the first skirt may be made of a mesh or open-woven material. In another example, the material of the first skirt may be perforated.

Optionally, the skateboard may also include a handle hingedly coupled to the skateboard. The first platform may define a first face extending radially from the pivot axis of the first hinge and substantially perpendicular to the first surface. The first face may define a recess in the first face. The recess may be sized and positioned to receive at least a portion of the handle.

Optionally, the first wheel may be disposed a first distance from the first hinge, and the second wheel may be disposed a second distance from the first hinge. A difference between the first distance and the second distance may be at least as large as about a diameter of the first wheel. Thus, as the skateboard is folded, the first and second wheels may bypass each other with clearance between the wheels.

Optionally, the first wheel may be disposed a first distance from the first hinge, and the second wheel may be disposed a second distance from the first hinge. A difference between the first distance and the second distance may be at least about 90% as large as a diameter of the first wheel and less than about the diameter of the first wheel, so as to provide an interference fit between the first wheel and the second wheel. Thus, as the skateboard is folded, the first and second wheels contact each other, and the first and second wheels prevent each other easily passing the other and inadvertently allowing the skateboard to unfold. However, the wheels and or their trucks include resilient material, so with reasonable effort by a human user, the first and second wheels can be made to pass each other and the skateboard may be unfolded.

The first platform may define a first face extending radially from the pivot axis of the first hinge and substantially perpendicular to the first surface. The skateboard may also include a magnet disposed in the first face. Due to an attractive force between the magnet and a metal (optionally magnetic) material in a second face defined by the second platform, the magnet may hold the skateboard in an unfolded orientation. However, with reasonable effort by a human user, the attractive force may be overcome to fold the skateboard.

Another embodiment of the present invention provides a skateboard that has concealable wheels. The skateboard is for use by a human. The skateboard includes an elongated wheel assembly. The wheel assembly has a longitudinal axis substantially aligned with an intended direction of rolling. The wheel assembly includes a first wheel, a second wheel and an interconnecting member. The first wheel is coupled to the second wheel by the interconnecting member. The first wheel and the second wheel are spaced apart along the longitudinal axis. The wheel assembly has an outer perimeter, as seen in a top view.

The skateboard also includes a platform that defines a surface adapted to receive at least a foot of the human. The platform includes at least two skirts extending (depending) from the platform. The at least two skirts define an inner perimeter, as seen in a bottom view. The platform and the at least two skirts define a recess. The outer perimeter of the wheel assembly is sized, such that the outer perimeter of the wheel assembly fits within the inner perimeter of the platform.

The at least two skirts may include four skirts arranged in a closed loop.

Yet another embodiment of the present invention provides a concealable skateboard. The skateboard includes an articulable beam. The articulable beam is characterized by an articulation axis and a top surface. The articulable beam includes a platform and a bottom surface. The articulable beam has a first and a second configuration. The platform is adapted to support a human in the first configuration. The skateboard also includes a first wheel and a second wheel. The first wheel and the second wheel are disposed on the bottom surface of the articulable beam. The first wheel and the second wheel are disposed on opposing sides with respect to the articulation axis. The skateboard also includes a skirt. The skirt is disposed substantially perpendicularly to the platform. The skirt is disposed in such a manner as to conceal both of the wheels in the second configuration.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

In accordance with embodiments of the present invention, methods and apparatus are disclosed for a foldable skateboard that hides its wheels when the skateboard is folded. Having a means of concealing the function of a skateboard and reducing its cumbersome nature would be an advantage to people who desire to commute using a skateboard.

Embodiments of the present invention overcome shortcomings of the prior art described above, as well as other shortcomings. According to embodiments of the present invention, a skateboard that can transform into a handheld case that obstructs the view of the wheels and wheel trucks. Once transformed, the wheels are located in an interior of the case. According to these embodiments, the skateboard has a multi-part platform, more than one wheel truck and, optionally, a handle for use in the transformed configuration.

All embodiments have an open configuration and a closed configuration. In the open configuration, the wheels are exposed and the device can be used as a skateboard. In some embodiments, in the closed configuration, the device transforms into a handheld case, where the wheel assemblies are contained within the interior of the case, and there is a handle to facilitate ease of carrying.

Some embodiments include a multi-part platform that a user can stand on in the open configuration. The platform includes some or all of the outer case of the closed configuration. The multi-part platform can be produced from any suitable material, such as plastic, wood, natural fibers, fiberglass, carbon fiber, metals, ceramics and composite combinations of such materials bound with adhesives, polymers and/or resins.

Figure 1:
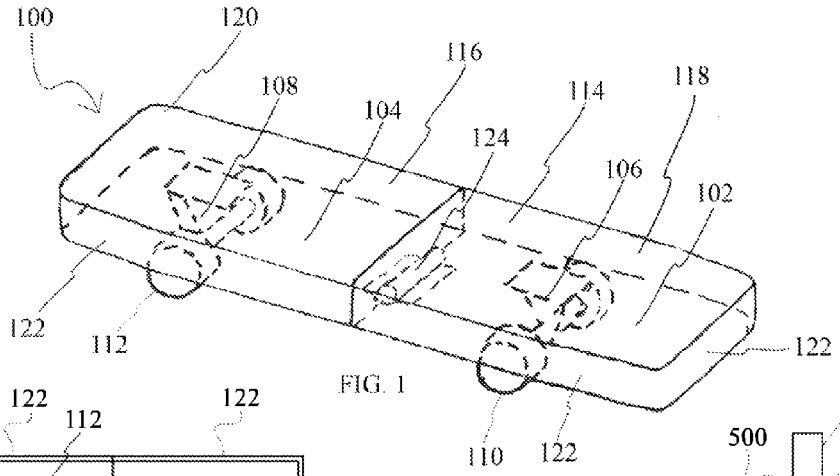
FIG. 1 is a perspective schematic view of a foldable skateboard, in an open configuration, according to an embodiment of the present invention.
Figure 2:
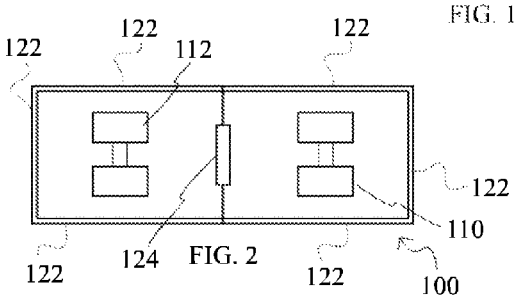
FIG. 2 is a bottom schematic view of the skateboard of FIG. 1.

One embodiment of a foldable skateboard 100 is illustrated in FIGS. 1-5. Referring to FIG. 1, the skateboard 100 includes a rear platform 102 and a front platform 104, each of which has a respective wheel truck 106 and 108 mounted to the underside thereof. Each wheel truck 106 and 108 has a respective at least one wheel 110 and 112. The wheels can be seen in FIG. 2, which is a bottom view of the skateboard 100.

Figure 3:
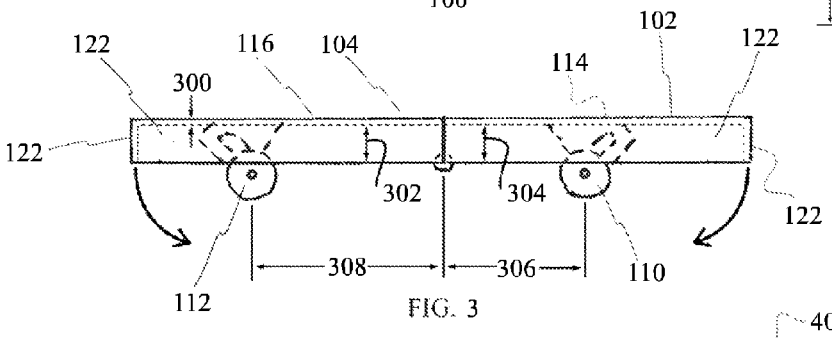
FIG. 3 is a side schematic view of skateboard of FIGS. 1-2.

Returning to FIG. 1, each platform 102 and 104 includes a top plate 114 and 116, respectively, that defines a respective surface 118 and 120, upon which a human user may stand. A thickness 300 of the top plate 116 is indicated in FIG. 3.

Each platform 102 and 104 has downward side walls (skirts) 122 along its edges that partially cover the wheels 110 and 112 in the open configuration. The side walls 122 may be a different thickness, material and/or texture than the top plates 114 and 116 in order to provide sufficient strength and flexibility of the platforms 102 and 104 to support a human user and to operate as a skateboard. In alternate embodiments, these side walls 122 can include separate components, such as hinges or bendable or foldable portions, that can be folded or hinged downwards or removed entirely and repositioned.

Thus, the side walls 122 may be switched from one mode to another mode. In one mode, the side walls 122 at least partially hide the wheels 110 and 112. In another mode, the side walls 122 do not hide the wheels 110 and 112, or at least hide less of the wheels 110 and 112. The modes of the side walls 122 may be changed independent of each other. Although side walls 122 are shown depending from two sides and one end of each of the platforms 102 and 104, the side walls 122 may depend from any number of edges of the platforms 102 and 104. The number of side walls 122 need not be the same on both platforms 102 and 104.

In at least one mode, the side walls 122 extend from the platforms 102 and 104 in a direction, relative to the platforms 120 and 104, opposite to the surfaces 118 and 120. At least in this mode, the side walls 122 extend a distance at least equal to a radius of one of the wheels 110 and/or 112. The side walls 122 define a recess having a depth 302 (FIG. 3). Thus, when the skateboard is folded, as shown schematically in FIG. 5, the wheel 110 enters the recess 302 defined by the side walls 122 and top plate 116 of platform 104. Wheel 112 enters a similar recess 304 defined by the side walls 122 and top plate 114 of the other platform 102. The side walls 122 hide at least a portion of at least one of the wheels 110 and/or 112. In another mode, the side walls 122 may be folded, rolled or otherwise changed in configuration so as not to hide the wheels 110 and/or 112, or not to hide the wheels 110 and/or 112 as much as in the first mode.

Figure 5:
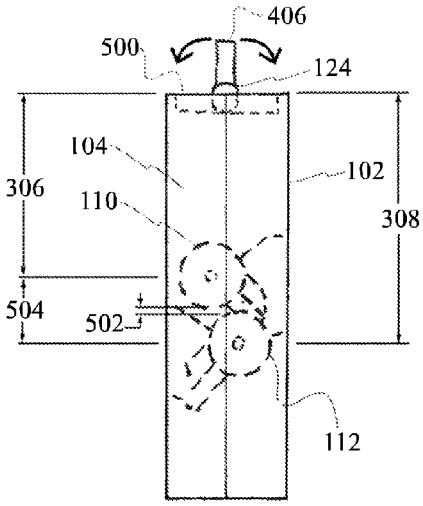
FIG. 5 is a side schematic view of the skateboard of FIGS. 1-4, in the closed configuration.

Returning to FIG. 1, a hinge mechanism 124 joins the two platforms 102 and 104 to allow the skateboard 100 to be transformed, such as by folding about the hinge 124, so that the wheels 110 and 112 become adjacent each other in the interior of the case, as shown in FIG. 5.

Figure 4:
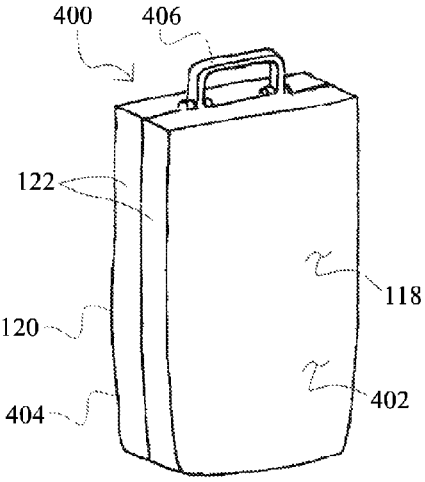
FIG. 4 is a perspective schematic view of the skateboard of FIGS. 1-3, in a closed configuration.

The closed configuration is illustrated in FIGS. 4 and 5, where the side walls 122 become the sides of a handheld case 400, and the surfaces 118 and 120 of the platforms 102 and 104 become front 402 and back 404 faces of the handheld case 400. As shown in FIG. 3, the wheel trucks 106 and 108 may be offset, in relation to the hinge 124, so that they do not intersect each other in the closed configuration. In other words, the wheel trucks 106 and 108, and therefore the wheels 110 and 112, may be disposed at different distances 306 and 308, respectively, from the hinge 124. The distances 306 and 308 are measured from corresponding locations on the wheels 110 and 112, such as from their respective axles, to a point of symmetry of the skateboard 100, such as the axis of the hinge 124.

The distances 306 and 308 may be selected to allow the wheels 110 and 112 to bypass each other as the skateboard 100 is being folded into the configuration shown in FIG. 5. A space 502 remains between the perimeters of the wheels 110 and 112, to allow the wheels 110 and 112 to bypass each other. A distance 504 is equal to a difference between distance 308 and distance 306. In embodiments in which the wheels 110 and 112 can bypass each other without touching each other, the distance 504 is greater than a diameter of a wheel 110 or 112 (assuming the wheels 110 and 112 are of equal diameter).

Figure 6:
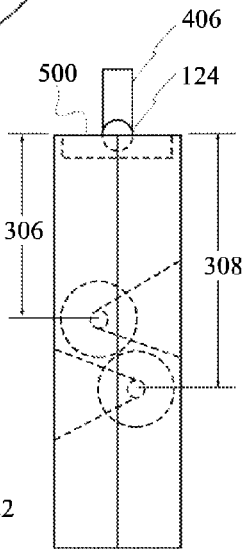
FIG. 6 is a side schematic view of a skateboard, in a closed configuration, according to another embodiment of the present invention.

Optionally, as shown in FIG. 6, the distances 306 and 308 may be selected to allow the wheels 110 and 112 to interfere with each other as the skateboard 100 is being folded into a configuration shown in FIG. 6. In other words, at least at one point along the swing of the two platforms 102 and 104, the perimeters of the wheels 110 and 112 collide. The interference fit between the wheels 110 and 112 inhibits the wheels 110 and 112 bypassing each other while the folded skateboard 100 is being carried or stored. However, reasonable effort by a human user can force the wheels 110 and 112 to bypass each other. During this bypassing, the wheels 110 and 112 (or one of them) and/or the wheel trucks 106 and 108 (or one of them) deform slightly. The wheels 110 and 112 and/or portions of the wheel trucks 106 and 108 may include resilient portions to allow this deformation and, therefore, facilitate the interference fit, yet be able to be deformed by reasonable human effort to fold and unfold the skateboard 100. In embodiments in which the wheels 110 and 112 interfere during folding or unfolding, the distance 504 is less than a diameter of a wheel 110 or 112.

As shown in FIGS. 4, 5 and 6, a handle 406 is mounted in the top of the closed configuration. The handle 406 can be rotated into a vertical position, as shown in FIGS. 4 and 5, for ease of transport. The handle 406 can be rotated, as indicated by arrows, and concealed in a recess 500 during the open configuration and revealed in the closed configuration. In some alternate embodiments, the handle 406 is visible in both configurations and may pull up vertically for its function to be realized. In other embodiments, the handle 406 is replaced by, or is complemented with, provision for attachment of one or two straps, allowing the skateboard 100 to be carried either on one shoulder or as a backpack.

Figure 7:
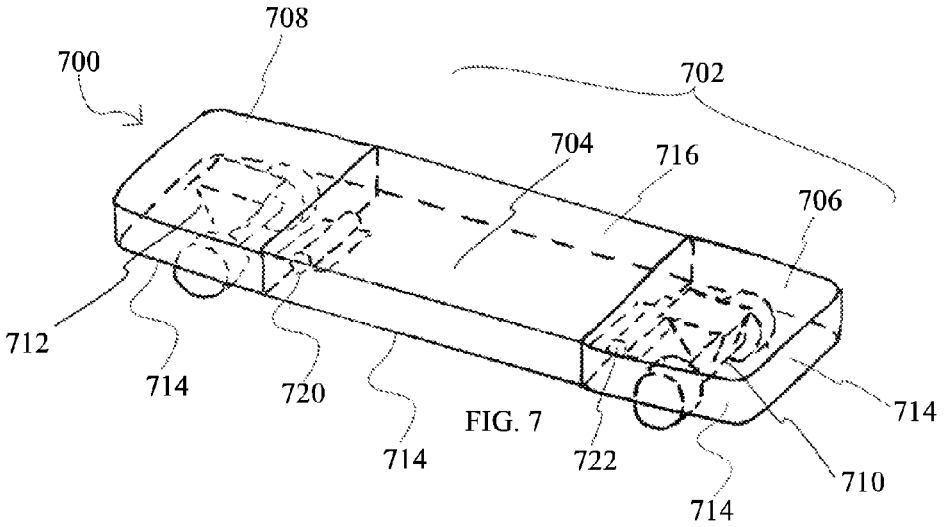
FIG. 7 is a perspective schematic view of a foldable skateboard, in an open configuration, according to another embodiment of the present invention.
Figure 8:
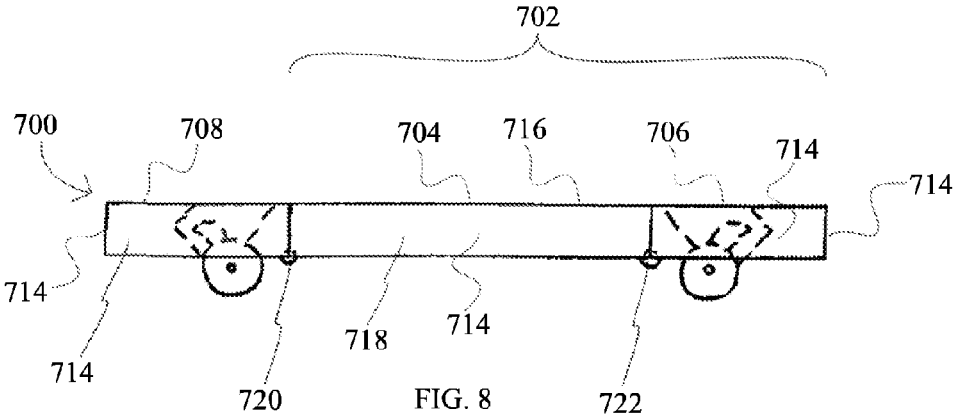
FIG. 8 is a side view of the skateboard of FIG. 7, in the open configuration.
Figure 9:
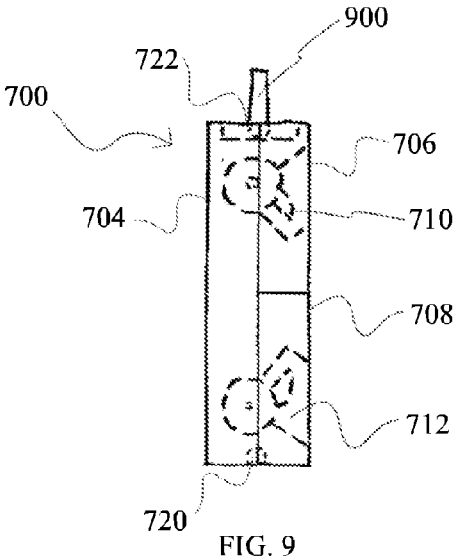
FIG. 9 is a side view of the skateboard of FIGS. 7 and 8, in a closed configuration.
Figure 10:
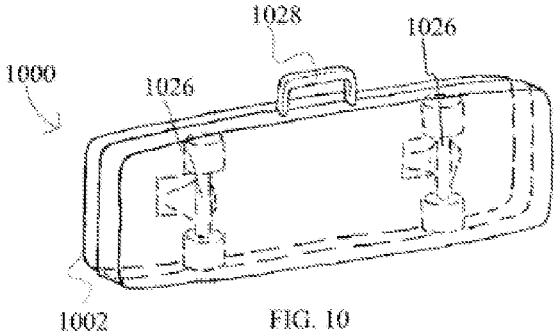
FIG. 10 is a perspective schematic view of a skateboard with nesting platforms, in a closed configuration, according to another embodiment of the present invention.
Figure 11:
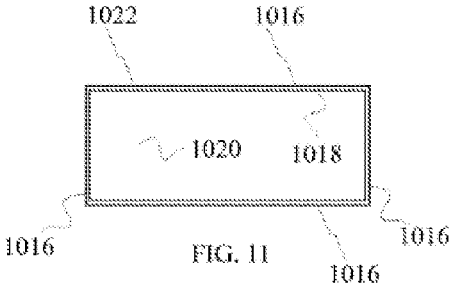
FIG. 11 is a bottom schematic view of the skateboard platform of FIG. 10.
Figure 12:
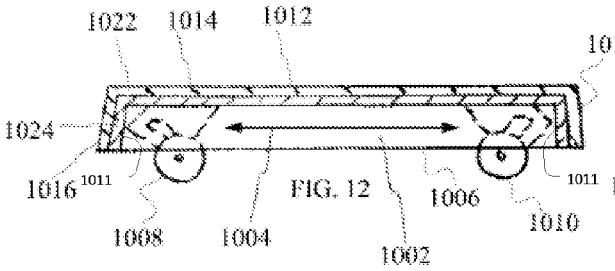
FIG. 12 is a side schematic view of the skateboard of FIGS. 10 and 11, in an open configuration.
Figure 13:
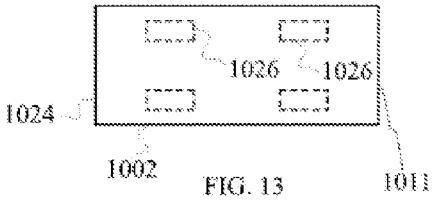
FIG. 13 is a top schematic view of the skateboard of FIGS. 10-12.
Figure 14:
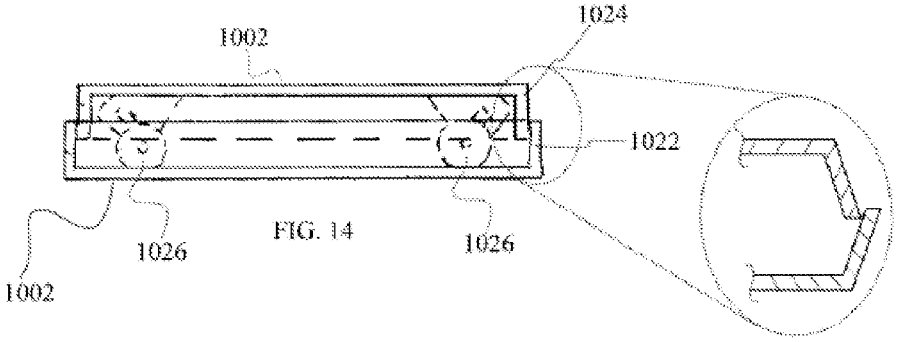
FIG. 14 is a side schematic view of the skateboard of FIGS. 10-13, in the closed configuration.
Figure 15:
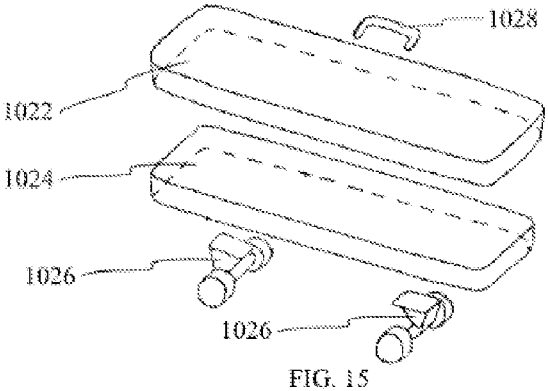
FIG. 15 is an exploded view of the skateboard of FIGS. 10-14.
Figure 16:
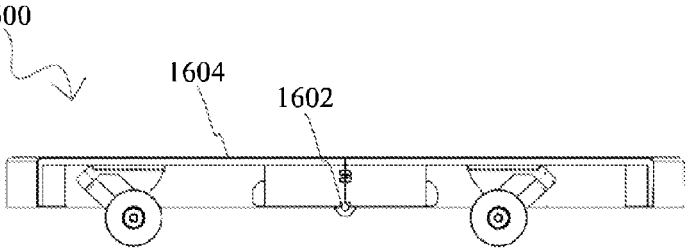
FIG. 16 is a side section view of a foldable skateboard, in an open configuration, according to another embodiment of the present invention.

Another embodiment of a foldable skateboard 700 is illustrated in FIGS. 7-9. The skateboard 700 is similar to the skateboard 100 described with respect to FIGS. 1-6, however in the skateboard 700, one platform 702 includes two hingedly coupled portions 704 and 706. The skateboard 700 includes a front platform 702 and a rear platform 708. A wheel truck 710 and 712 is mounted to the underside of each platform 702 and 708. The platforms 702 and 708 have dependent side walls 714, as described with respect to FIGS. 1-6. The side walls 714 and a top plate 716 of one portion 704 of the front platform 702 define a recess 718.

A hinge 720 joins the front platform 702 to the rear platform 708, and another hinge 722 joins the two portions 704 and 706 of the front platform 702. The two hinges 720 and 722 allow the skateboard 700 to be transformed, so that the rear platform 708 and one portion 706 of the front platform 702 are inverted so that the wheel trucks 710 and 712 face the recess 718 of the case, as shown in FIG. 9. A handle 900 can be mounted in one or both ends of the closed configuration in the same manner described in the first embodiment. Alternatively, the handle may be mounted on side walls 714 to facilitate carrying in the other orientation. The side walls 714 may also be a different thickness, material or texture than the top surface 716 of the platform 702, 708 in order to maximize strength and flexibility of the platform as described in the first embodiment. In alternate embodiments these side walls 714 can comprise of separate components that can be folded downwards or removed entirely and repositioned.

Another embodiment of a skateboard 1000 is illustrated in FIGS. 10-15. The skateboard 1000 platform includes two layers that are stacked, one on top of the other. Layer 1022 fits over layer 1024 when the skateboard is in the open configuration, shown in FIG. 12. Layer 1022 is removable, as shown by the exploded view in FIG. 15. Layer 1022 can be inverted and located to conceal the wheel assemblies 1026 to create the closed configuration. The handle 1028 can be located on either layer 1022 or layer 1024 and may form part of the locking mechanism. Each layer is made up of a top surface and side walls. The side walls may also be a different thickness, material or texture than the top surface of the platform in order to maximize strength and flexibility of the platform as described in the first embodiment. In alternate embodiments these side walls can comprise of separate components that can be folded downwards or removed entirely and repositioned.

Layer 1024 includes an elongated wheel assembly 1002. The wheel assembly 1002 has a longitudinal axis 1004 substantially aligned with an intended direction of rolling. The wheel assembly 1002 includes a first wheel 1008, a second wheel 1010 and an interconnecting member 1006. The first wheel 1008 is coupled to the second wheel 1010 by the interconnecting member 1006. The first wheel 1008 and the second wheel 1010 are spaced apart along the longitudinal axis 1004. The wheel assembly 1010 has an outer perimeter 1011, as seen in a top view FIG. 13. Layer 1024 may include skirts 1011.

Layer 1022 includes a platform 1012 that defines a surface 1014 adapted to receive at least a foot of the human. The platform 1012 includes at least two skirts (side walls) 1016 extending (depending) from the platform. The at least two skirts 1016 define an inner perimeter 1018, as seen in a bottom view FIG. 11. The platform 1012 and the at least two skirts 1016 define a recess 1020. The outer perimeter 1011 of the wheel assembly 1002 is sized, such that the outer perimeter 1011 of the wheel assembly 1002 fits within the inner perimeter 1018 of the platform 1012. The at least two skirts 1016 may include four skirts arranged in a closed loop.

Figure 17:
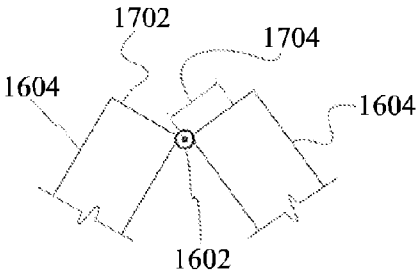
FIG. 17 is a partial side view of the skateboard of FIG. 16, showing a hinge in a partially closed configuration.
Figure 18:
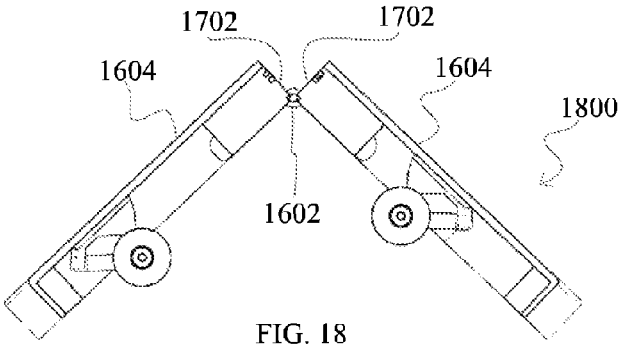
FIG. 18 is a side section view of the skateboard of FIGS. 16 and 17, in the partially closed configuration.
Figure 19:
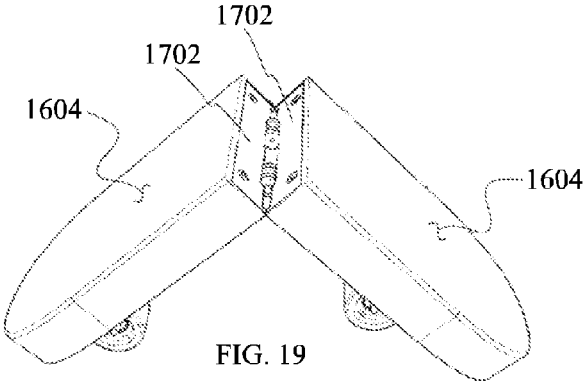
FIG. 19 is a perspective view of the skateboard of FIGS. 16-18, in the partially closed configuration.
Figure 20:
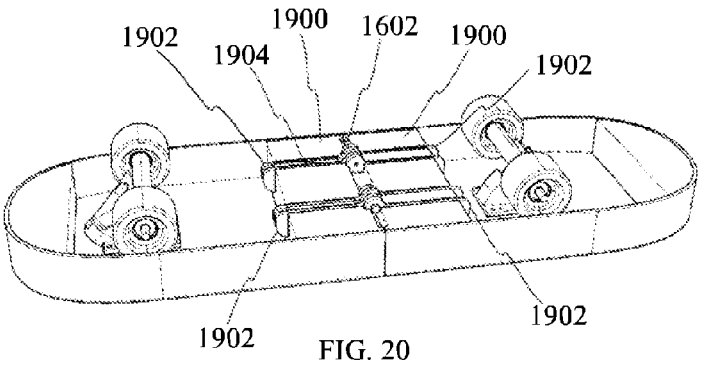
FIG. 20 is a perspective view of the skateboard of FIGS. 16-19, in the open configuration.

FIGS. 16-20 illustrate how the open configuration of embodiments, such as those described with respect to FIGS. 1-9 and 24-52, can be held in a flat, aligned state. This is realized by the inner end surface 1702 of each platform 1604 butting up against each other. These two surfaces 1702 are either the same continuous materials as the platform 1604 or are rigidly attached to the platform 1604. These inner end surfaces 1702 can be an arbitrary shape so long as they create some offset distance between the open configuration surface of contact between the two platform sections 1604 and the axis of rotation of the hinge 1602. The hinge mechanism may have an optimized offset 1704 between the top surfaces 1604 of the platform sections and the end of the hinge axis of rotation in order to reduce the forces on the hinge, as illustrated in FIG. 17. The hinge may also have long arms 1904 in order to maximize the shear strength between the hinge and the component that the hinge is attached to that is rigidly coupled to the top surfaces 1604. Longer hinge arms 1904 can also be rigidly fastened to top surface either directly or indirectly through a hinge mount platform 1900. The hinge arms 1904 can also be hooked such that the hook comes into contact with the platform when the user is standing on the board. With longer hinge arms, there is a larger amount of material in shear resisting the pulling of the hinge.

Figure 21:
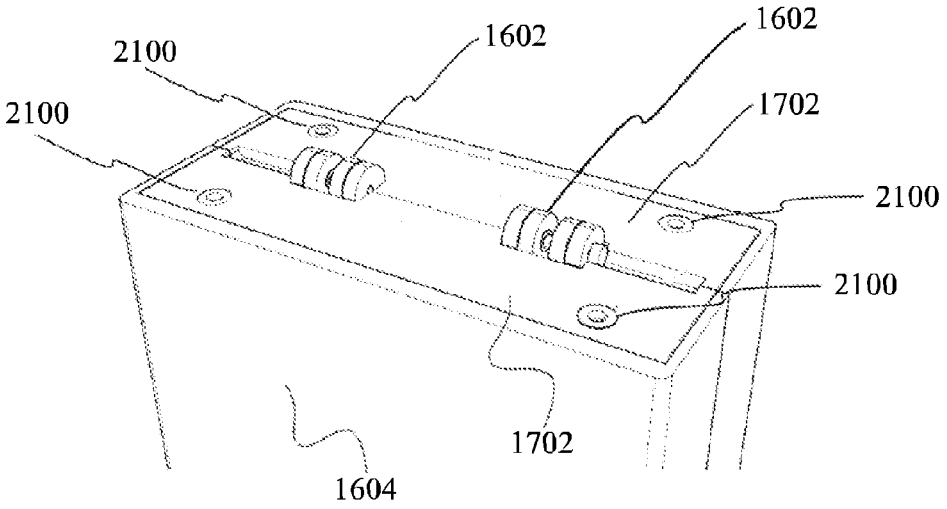
FIG. 21 is a partial perspective view of a folding skateboard, in a closed configuration, according to another embodiment of the present invention.
Figure 22:
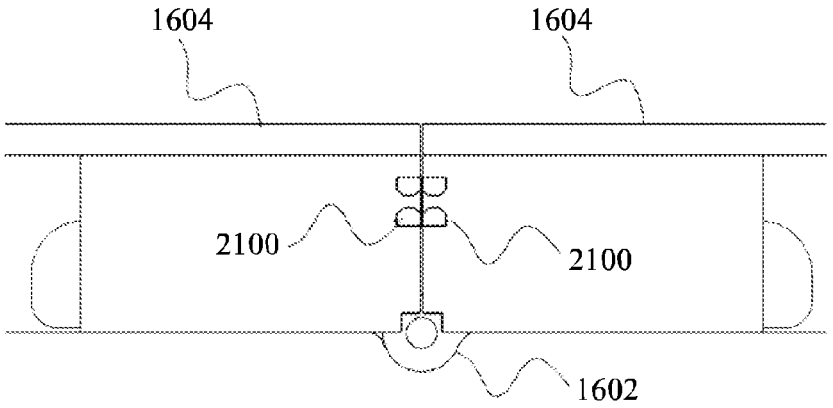
FIG. 22 is a partial side section view of the skateboard of FIG. 21, in an open configuration.
Figure 23:
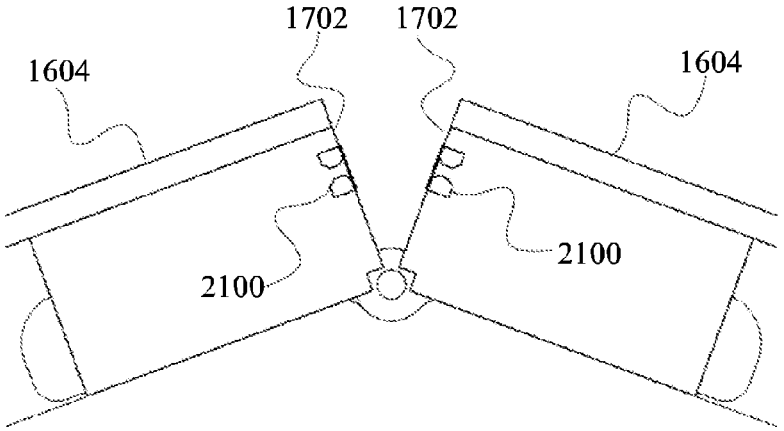
FIG. 23 is a partial side section view of the skateboard of FIGS. 21 and 22, in a partially closed configuration.

FIGS. 21-23 illustrate how, in accordance with some embodiment, the open configuration may be held open with magnets 2100 located in the mating surfaces 1702 of the platform sections. Optional or alternative embodiments can include other locking mechanisms, such as spring pins, locks and latches to secure the skateboard in the open or closed configurations.

Figure 24:
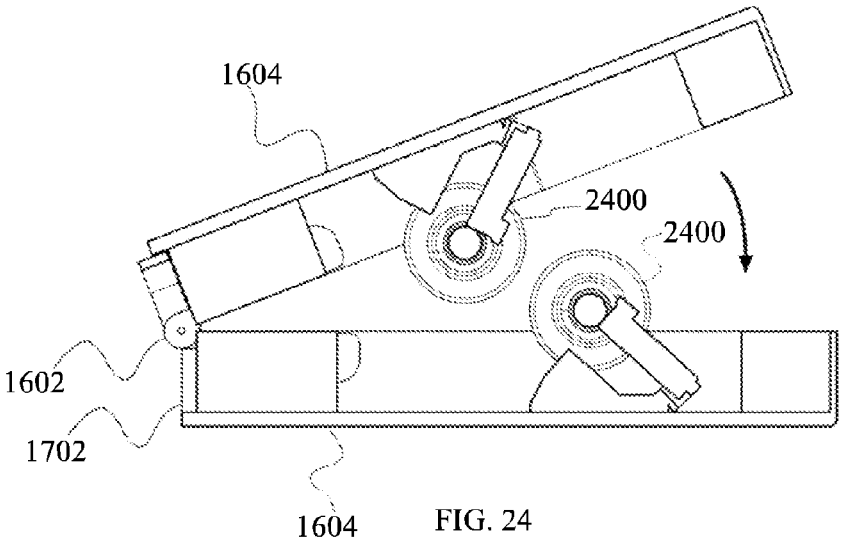
FIG. 24 is a side section view of a folding skateboard, in a partially closed configuration, according to another embodiment of the present invention.
Figure 25:
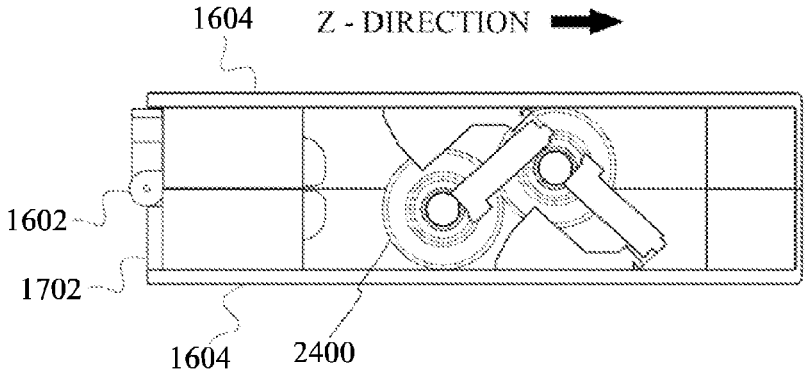
FIG. 25 is a side section view of the skateboard of FIG. 24, in a closed configuration.
Figure 26:
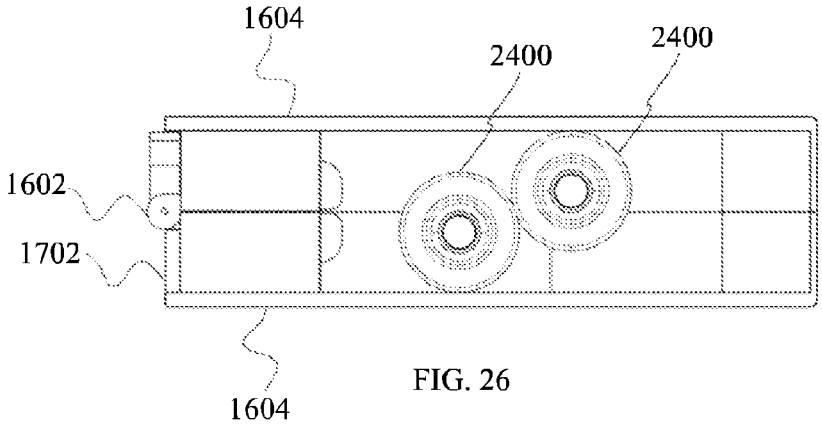
FIG. 26 is a side section view of the skateboard of FIGS. 24 and 25, in the closed configuration.

FIGS. 24-26 illustrate how, in accordance with an embodiment, the wheels 2400 interfere when the case is closing such that the case stays shut once they pass each other, according to some embodiments. The wheels may be made of a flexible material, for example urethane. The flexure of the wheels allows them to squeeze past one another while the case is closing. The trucks can also have some flex, which allows the wheels to displace slightly so that the wheels can squeeze past each other. The location of the wheel assemblies is configured so that once they pass each other they are still touching and overlap by a considerable distance in the Z-direction causing a clamping force to keep the case secured in the closed configuration.

Figure 27:
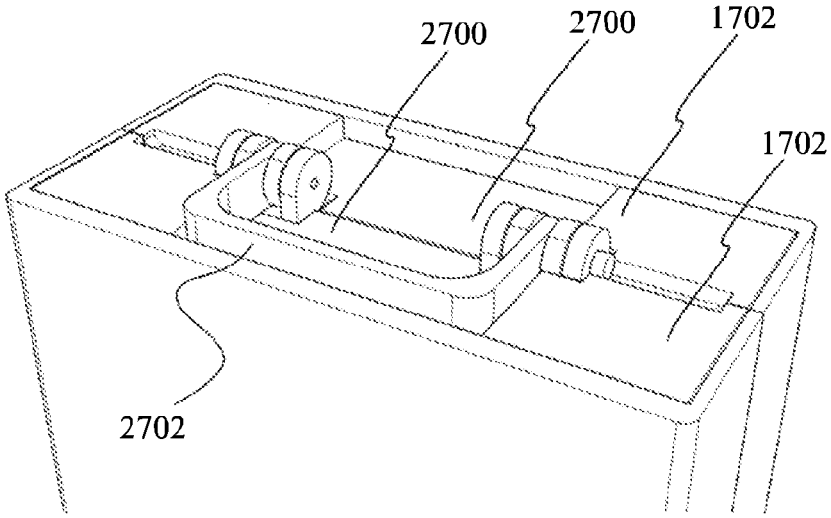
FIG. 27 is a partial perspective view of a folding skateboard, showing a handle in a folded configuration.
Figure 28:
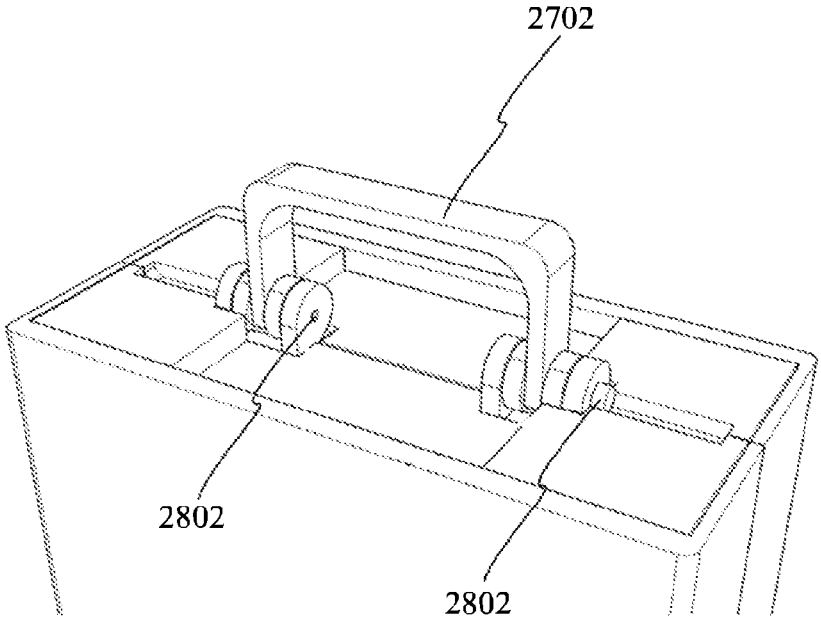
FIG. 28 is a partial perspective view of the skateboard of FIG. 27, showing the handle in an unfolded configuration.

FIGS. 27 and 28 illustrate how the function of the handle 2702 may be realized in accordance with hinged embodiments. The handle can be rotated vertically or horizontally around an axis 2802 in the closed configuration. The handle can be integrated into the hinge mechanism, which is featured in some embodiments, sharing the same axis of rotation or can be implemented as its own independent feature. There can be a recess 2700 in the mating faces 1702 of the platforms sections where the handle is located. This allows the handle to sit parallel with the mating faces so that it can be enclosed within the platform when the skateboard is in its open configuration. This is advantageous as it prevents interference with the user's feet in the open configuration and reduces the collection of dirt and debris on the handle.

Figure 29:
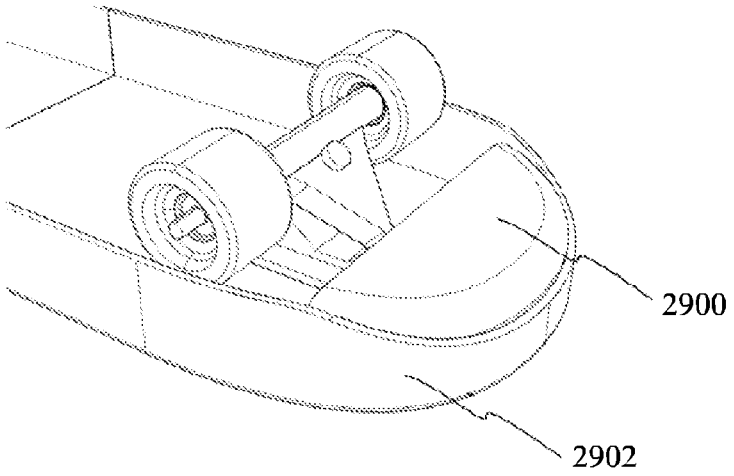
FIG. 29 is a partial perspective bottom view of a folding skateboard, according to another embodiment of the present invention.
Figure 30:
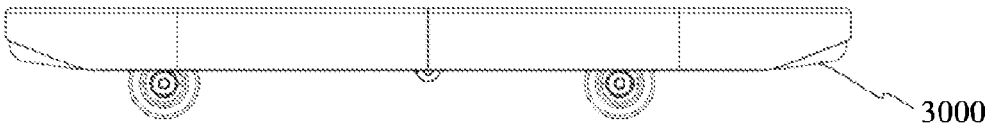
FIG. 30 is a side view of the skateboard of FIG. 29, in an open configuration.
Figure 31:
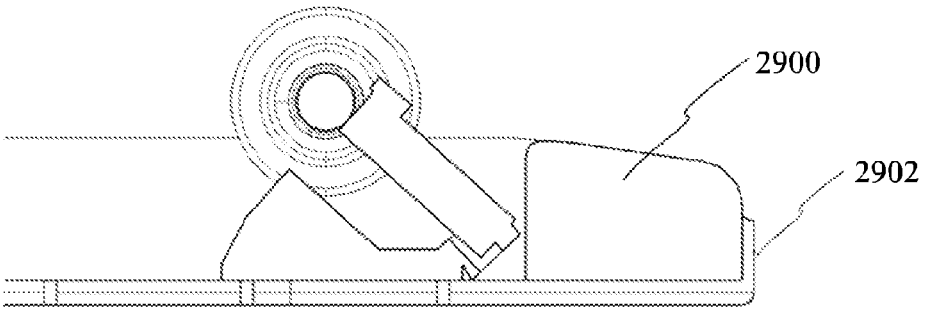
FIG. 31 is a partial side section view of the skateboard of FIGS. 29 and 30.

FIGS. 29-31 illustrate how, in accordance with an embodiment, a solid section 2900, also known as a skid block, at the ends of the platforms, may also be used to increase wear resistance of the side walls 2902 from the action of tail or tip scraping. Tail and tip scraping can be a common occurrence, where the ends of the board come in contact with the ground when going over an obstacle or when pressed down upon by the foot. Pivoting can be defined as a common skateboard action where the user applies pressure to either the tip or tail the skateboard to apply a quick change of movement. The skid blocks can be removable from the platforms as to allow replacement once they become overly worn from use. Pivoting characteristics can be customized and optimized by changing the size, shape and the material of the skid block. The skid blocks geometry can be realized in a number of ways. This can include, but is not limited to, tapered towards the back of the board, as shown in FIG. 30, flat so that the bottom surface 3000 is horizontal or a curved shape.

Figure 32:
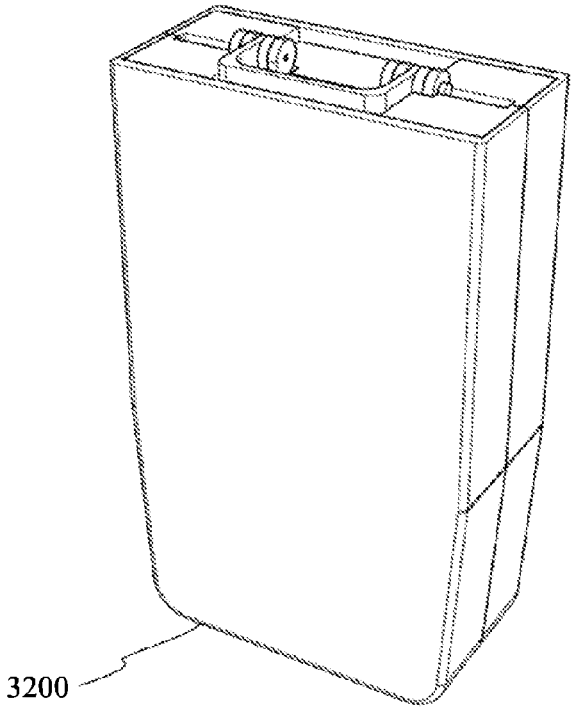
FIG. 32 is a perspective view of a folding skateboard with squared ends, in a closed configuration, according to another embodiment of the present invention.
Figure 33:
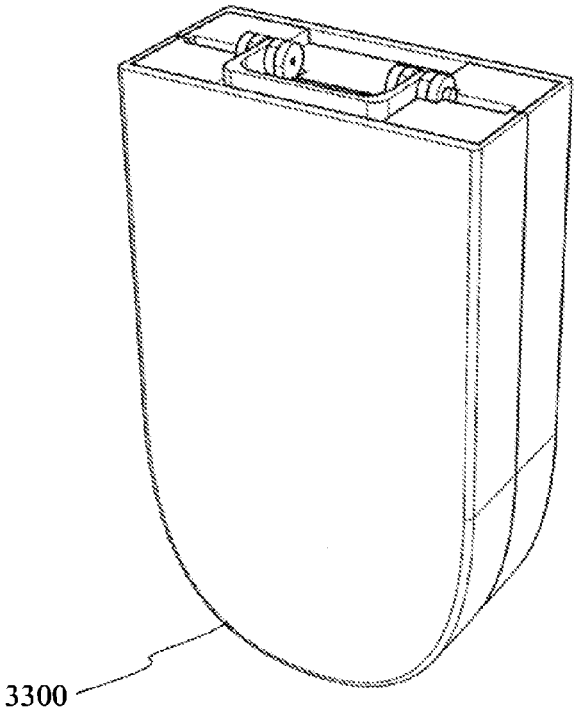
FIG. 33 is a perspective view of a folding skateboard with rounded ends, in a closed configuration, according to another embodiment of the present invention.

FIGS. 32 and 33 illustrate that, in accordance with another embodiment, the end shape of the platforms may be square 3200 or rounded 3300 by varying degrees of radius so that the closed configuration can be made to stand upright independently.

Figure 34:
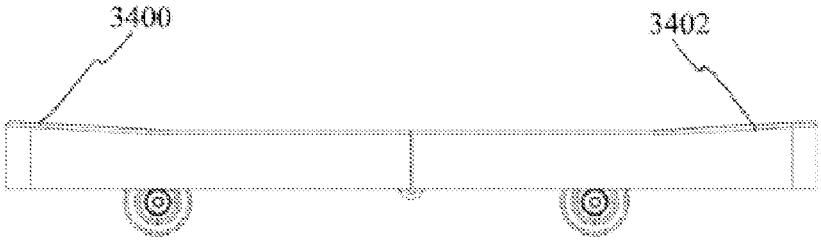
FIG. 34 is a side view of a folding skateboard with flat edge skirt tips, in an open configuration, according to another embodiment of the present invention.
Figure 35:
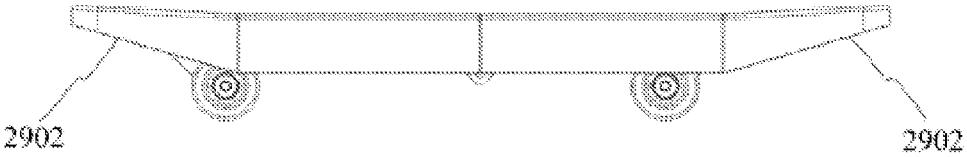
FIG. 35 is a side view of a folding skateboard with tapered edge skirt tips, in an open configuration, according to another embodiment of the present invention.
Figure 36:
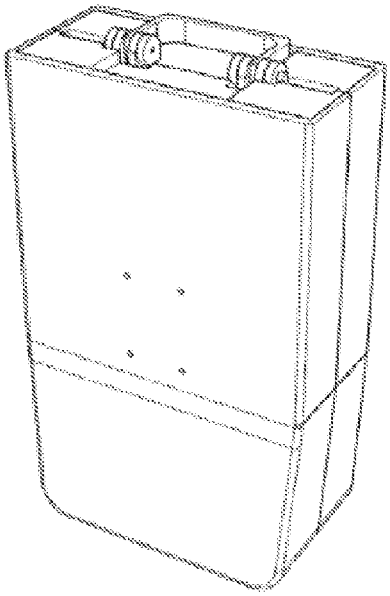
FIG. 36 is a perspective view of the skateboard of FIG. 34, in a closed configuration.
Figure 37:
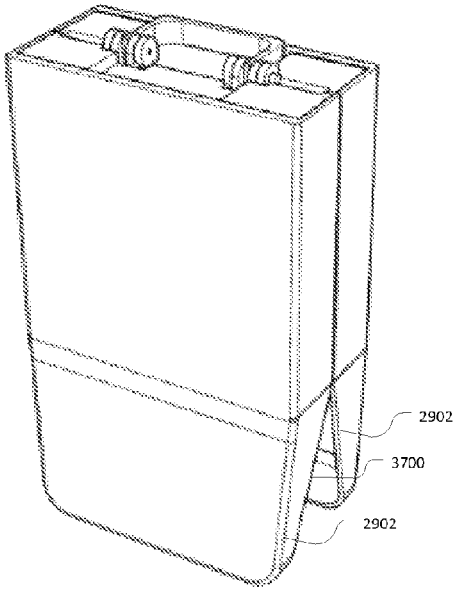
FIG. 37 is a perspective view of the skateboard of FIG. 35, in a closed configuration.

FIGS. 34 and 35 illustrate an alternate embodiment where the tail 3400 and nose 3402 of the platform can be angled to improve the maneuverability of the skateboard in the open configuration. FIGS. 36 and 37 show a variation on this embodiment, where the side walls 2902 can be chamfered or tapered to increase the performance of pivoting and minimize the wear inflicted to the tip and tail from tail scraping in the open configuration. The chamfer geometry also results in a gap 3700 in the closed configuration in which fingers or a hand can be inserted thus facilitating the opening of the skateboard.

Figure 38:
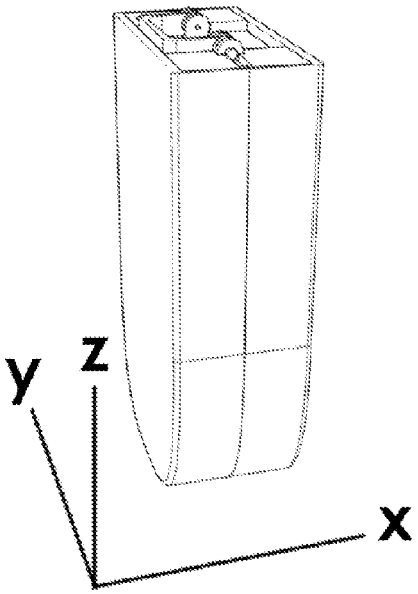
FIG. 38 is a perspective view of a folding skateboard, in a closed configuration, according to another embodiment of the present invention.
Figure 39:
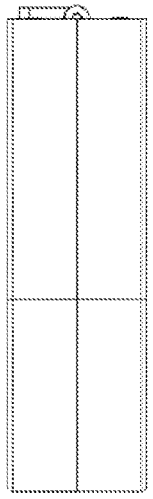
FIG. 39 is a side view of the skateboard of FIG. 38, in the closed configuration.

FIGS. 38 and 39 illustrate how, in accordance with another embodiment, the closed configuration can define of a completely enclosed void that contains the wheels and trucks in the interior of the case. A completely enclosed void will visibly obstruct the trucks and wheels from all viewing angles. The interior of the case can reasonably contain a small object without it falling out.

Figure 40:
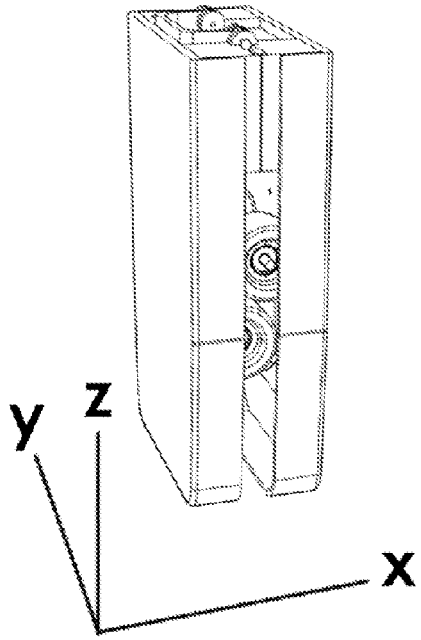
FIG. 40 is a perspective view of a folding skateboard, in a closed configuration, according to another embodiment of the present invention.
Figure 41:
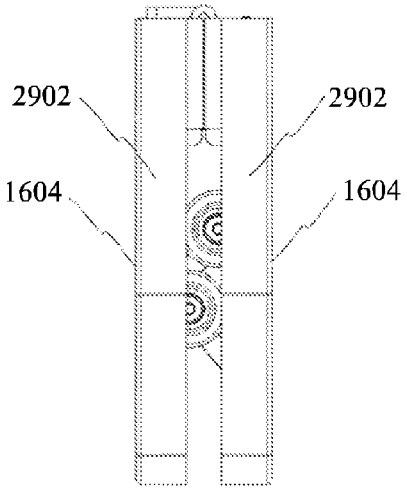
FIG. 41 is a side view of the skateboard of FIG. 40, in the closed configuration.

FIGS. 40 and 41 illustrate how, in accordance with another embodiment, the closed configuration can define of a partially closed void that contains the wheel assemblies in the interior of the case. In the partially closed void the top surfaces 1604 of the platform sections will fully cover or obscure the view of the wheel assemblies from both sides in the x direction. The platform sections will fully cover or obscure the view of the wheel assemblies from one or both sides of the z direction. The wheel assemblies will be partially covered or obscured from both sides of the y direction by the side walls 2902, for example 50% of the wheel assemblies may be visibly obscured. This can be achieved through opaque side walls that are 50% the diameter of the wheel assemblies or a perforated material 4200 (FIG. 42) that spans the entire height, but visibly obstructs some, most or all of the wheel assemblies.

Figure 42:
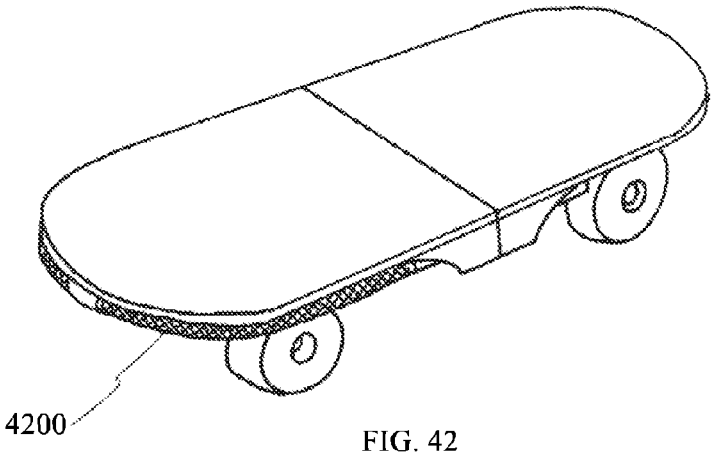
FIG. 42 is a perspective view of a folding skateboard, in an open configuration, according to another embodiment of the present invention.
Figure 43:
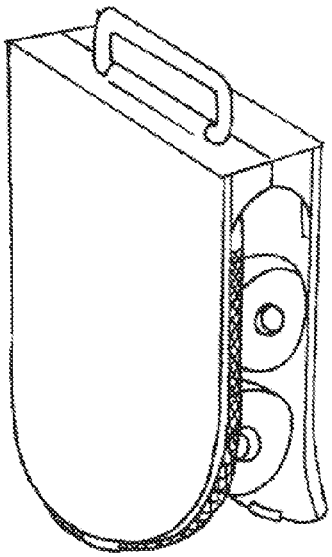
FIG. 43 is a perspective view of the skateboard of FIG. 42, in a closed configuration, showing a skirt in a retracted position.
Figure 44:
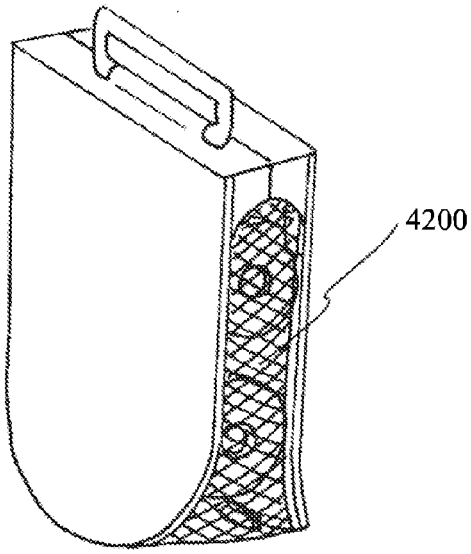
FIG. 44 is a perspective view of the skateboard of FIGS. 42 and 43, in a closed configuration, showing the skirt in a deployed position.

The side walls of the platform sections may interfere with the riding performance of the device. Therefore, in an alternative embodiment, the disguising elements are flexible or can fold away in order to improve the riding experience. FIGS. 42, 43 and 44 illustrate one such embodiment, where the disguising element is a perforated material, fabric, netting or mesh 4200. The side wall material can be retracted while the device is being ridden. Once the device is transformed into the closed configuration, the side wall material can be extended from one edge and attached to the other using magnets, hooks, or another standard attachment device.

Figure 45:
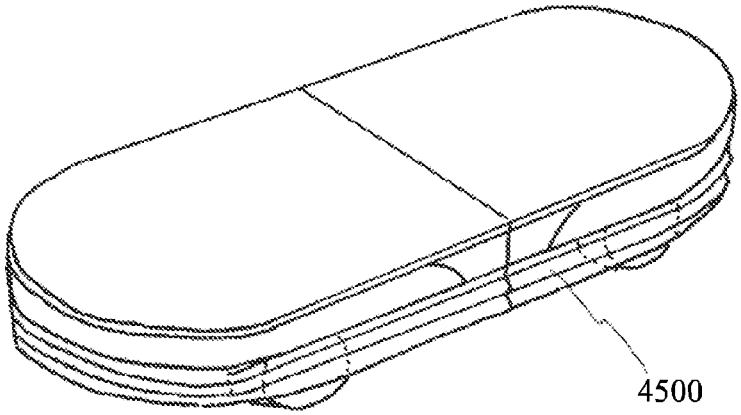
FIG. 45 is a perspective view of a folding skateboard, in an open configuration, according to another embodiment of the present invention.
Figure 46:
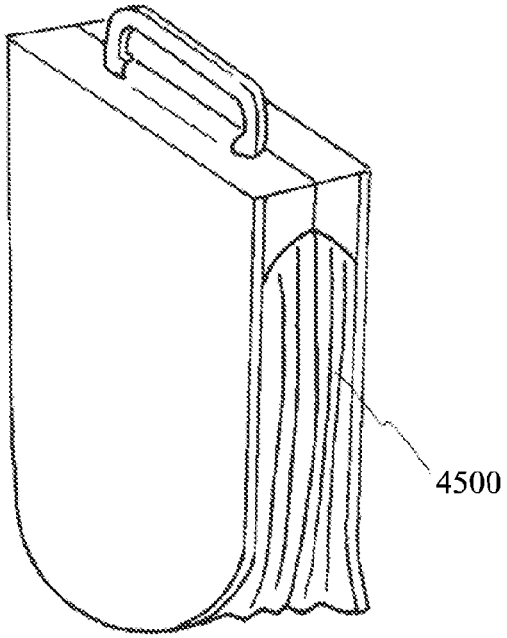
FIG. 46 is a perspective view of the skateboard of FIG. 45, in a closed configuration.
Figure 47:
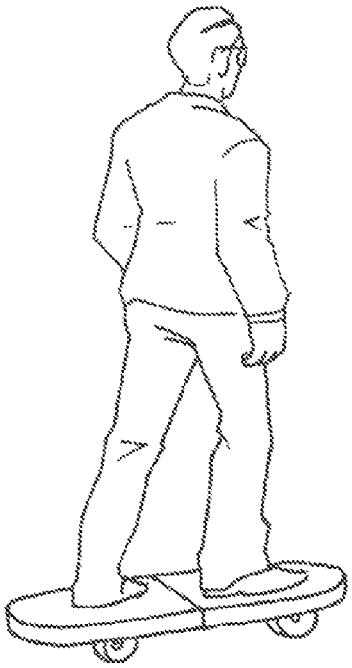
FIG. 47 is a view of a human riding a folding skateboard, according to another embodiment of the present invention.

FIGS. 45 and 46 illustrate another alternate embodiment, where the side covers 4500 of the device are partially flexible, using a collapsible mechanism similar to an accordion folder. This design allows the device to accommodate a wider range of terrain or obstacles, as the side covers retracts in response to the obstacles. When folded, the side covers fully conceal the wheels and other mechanisms.

Figure 48:
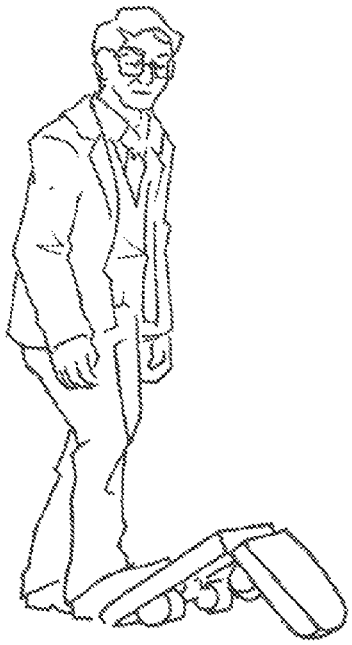
FIG. 48 is a view of the human folding the skateboard of FIG. 47 into a partially closed configuration.
Figure 49:
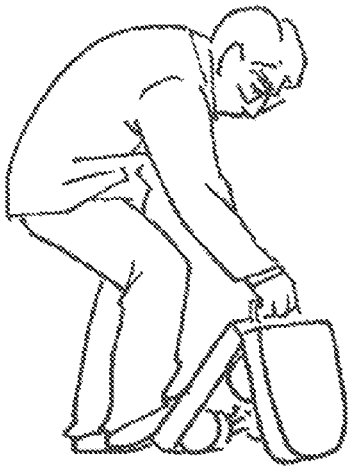
FIG. 49 is a view of the human deploying a handle affixed to the skateboard of FIGS. 47 and 48 to pick up the skateboard.
Figure 50:
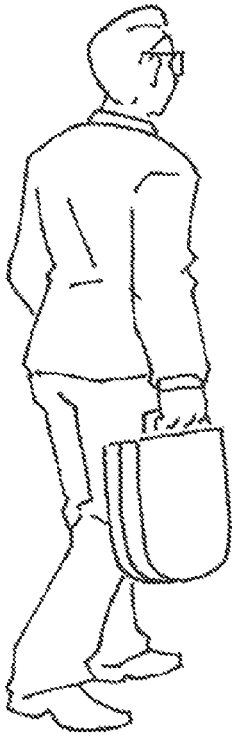
FIG. 50 is a view of the human carrying the skateboard of FIGS. 47-49 by means of the handle, where the skateboard is in a closed configuration.
Figure 51:
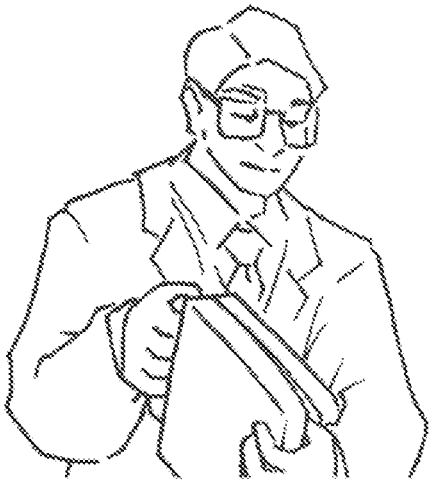
FIG. 51 is a view of the human unfolding the skateboard of FIGS. 47-50 into a partially open configuration, according to an embodiment of the present invention.
Figure 52:
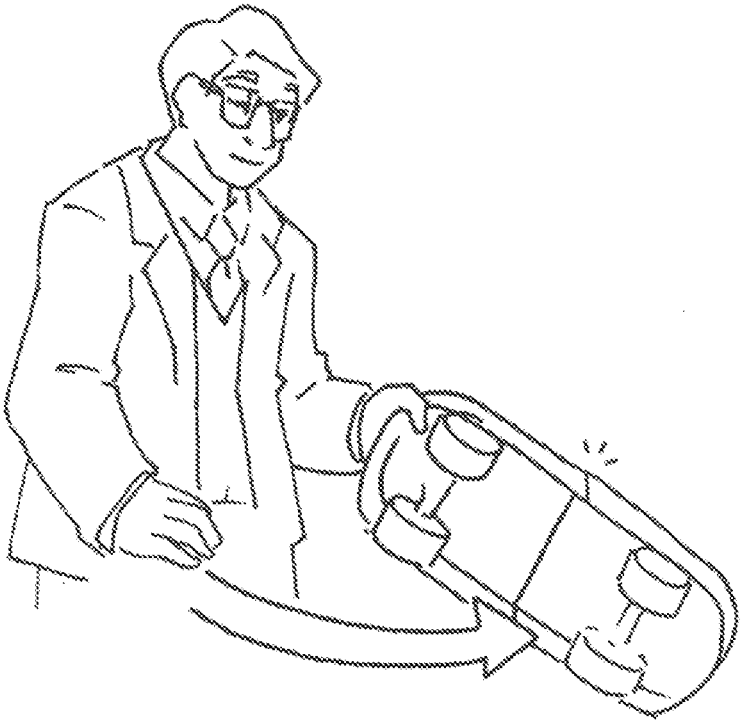
FIG. 52 is a view of the human unfolding the skateboard of FIGS. 47-51 to an open configuration.

FIGS. 47, 48, 49, 50, 51 and 52 illustrate a method by which the intended user interaction with the device may be realized in accordance with another embodiment. FIG. 48 illustrates how, upon dismounting the device, the user can tilt one end of the device using their foot. When pressed hard enough, the inertial weight of the other end of the board automatically causes the hinge mechanism to open, exposing the handle. The user can then reach down to collect the handle. The case collapses into its closed configuration once lifted. The magnets described earlier, with respect to FIG. 28, and the geometry of the tail can be configured in order to achieve this action. The magnets can be made to be strong enough that the skateboard stays open when a tip or tail is accidentally pressed down, or when pivoting, but that the skateboard begins to close if a tip or tail is pressed down with a sufficient impulse. Further latch hinges, magnets or clasps may be incorporated to further secure the device in its closed configuration. To open the device, a user would hold the device from one end. One fluid motion, as illustrated in FIGS. 51 and 52 would overcome the closing spring force and allow the device to snap into its opened state. One example embodiment is the use of spring latches will ensure that that once opened, the device remains opened until sufficient force is applied to close it, so the user need only lay the device on the ground to begin riding.

While the invention is described through the above-described exemplary embodiments, modifications to, and variations of, the illustrated embodiments may be made without departing from the inventive concepts disclosed herein. Furthermore, disclosed aspects, or portions thereof, may be combined in ways not listed above and/or not explicitly claimed. Accordingly, the invention should not be viewed as being limited to the disclosed embodiments.

What is claimed is:

1. A folding skateboard having concealable wheels, the skateboard being for use by a human and comprising:

a first platform comprising a first wheel and defining a first surface adapted to receive at least a portion of a foot of the human;

a second platform disposed along a longitudinal axis shared with the first platform, comprising at least one second wheel and defining a second surface adapted to receive at least a portion of another foot of the human;

a first hinge having a pivot axis substantially perpendicular to the longitudinal axis, the first platform being hingedly coupled to the second platform by the first hinge;

a first skirt attached to the first platform such that, at least in one skirt mode, the first skirt extends from the first platform, in a direction, relative to the first platform, opposite to the first surface, a distance at least equal to a radius of the at least one first wheel; and a second skirt attached to the second platform such that, at least in one skirt mode, second skirt extends from the second platform, in a direction, relative to the second platform, opposite to the second surface, a distance at least equal to a radius of the at least one second wheel, such that in a first folding mode, the first and second skirts collectively substantially obscure the first and second wheels from a point of view external to the folding skateboard.

2. A skateboard according to claim 1, wherein the first platform further comprises:

a second hinge;

a first portion; and a second portion hingedly coupled to the first portion by the second hinge; wherein:

the first surface extends over the first portion and over the second portion; and the first skirt is attached to the first portion of the first platform.

3. A skateboard according to claim 1, wherein the first skirt is retractable.

4. A skateboard according to claim 1, wherein the first skirt defines a plurality of apertures therethrough.

5. A skateboard according to claim 1, further comprising:

a handle hingedly coupled to the skateboard; wherein:

the first platform defines a first face extending radially from the pivot axis of the first hinge and substantially perpendicular to the first surface, the first face defining a recess therein, sized and positioned to receive at least a portion of the handle.

6. A skateboard according to claim 1, wherein:

the first wheel is disposed a first distance from the first hinge;

the second wheel is disposed a second distance from the first hinge;

a difference between the first distance and the second distance is at least as large as about a diameter of the first wheel.

7. A skateboard according to claim 1, wherein:

the first wheel is disposed a first distance from the first hinge;

the second wheel is disposed a second distance from the first hinge;

a difference between the first distance and the second distance is at least about 90% as large as a diameter of the first wheel and less than about the diameter of the first wheel, so as to provide an interference fit between the first wheel and the second wheel.

8. A skateboard according to claim 1, wherein the first platform defines a first face extending radially from the pivot axis of the first hinge and substantially perpendicular to the first surface, the skateboard further comprises:

a magnet disposed in the first face.

9. A concealable skateboard comprising:

an articulable beam characterized by an articulation axis and a top surface constituting a platform and a bottom surface, the articulable beam having a first and a second configuration, wherein the platform is adapted to support a human in the first configuration;

a first wheel and a second wheel disposed on the bottom surface of the articulable beam on opposing sides with respect to the articulation axis;

a first skirt attached to a first portion of the articulable beam such that, at least in one skirt mode, the first skirt extends from the first portion of the articulable beam, in a direction, relative to the top surface opposite to the top surface, a distance at least equal to a radius of the first wheel; and a second skirt attached to a second portion of the articulable beam such that, at least in one skirt mode, the second skirt extends from the second portion of the articulable beam in a direction, relative to the top surface, opposite to the top surface, a distance at least equal to a radius of the second wheel, such that in a first folding mode, the first and second skirts collectively substantially obscure the first and second wheels from a point of view external to the concealable skateboard.

* * * * *